US006217295B1

(12) United States Patent
Kato et al.

(10) Patent No.: US 6,217,295 B1
(45) Date of Patent: Apr. 17, 2001

(54) SWASH PLATE TYPE COMPRESSOR

(75) Inventors: Takayuki Kato; Hayato Ikeda; Seiji Katayama; Masaaki Taga, all of Kariya (JP)

(73) Assignee: Kabushiki Kaisha Toyoda Jidoshokki Seisakusho, Aichi-ken (JP)

( * ) Notice: Subject to any disclaimer, the term of this patent is extended or adjusted under 35 U.S.C. 154(b) by 0 days.

(21) Appl. No.: 09/319,646

(22) PCT Filed: Sep. 29, 1998

(86) PCT No.: PCT/JP98/04378

§ 371 Date: Jun. 9, 1999

§ 102(e) Date: Jun. 9, 1999

(87) PCT Pub. No.: WO99/19626

PCT Pub. Date: Apr. 22, 1999

(30) Foreign Application Priority Data

Oct. 9, 1997 (JP) ..... 9-277657
Apr. 16, 1998 (JP) ..... 10-106713

(51) Int. Cl.[7] ..... F04B 1/12; F01B 31/10
(52) U.S. Cl. ..... 417/269; 417/222.2; 92/155
(58) Field of Search ..... 417/269, 222.1, 417/222.2; 92/71, 155

(56) References Cited

U.S. PATENT DOCUMENTS 4,577,549 * 3/1986 Frank et al. ..... 92/169
4,641,570 * 2/1987 Futamura et al. ..... 92/71
4,708,104 * 11/1987 Day et al. ..... 123/193 P
5,056,417 * 10/1991 Kato et al. ..... 92/71
5,490,767 * 2/1996 Kanou et al. ..... 417/222.1
5,615,599 * 4/1997 Terauchi ..... 417/269
5,868,556 * 2/1999 Umemura ..... 417/269
5,934,172 * 8/1999 Terauchi ..... 417/269

FOREIGN PATENT DOCUMENTS

012227876 * 9/1989 (JP) .

* cited by examiner

*Primary Examiner*—Charles G. Freay
*Assistant Examiner*—Michael K. Gray
(74) *Attorney, Agent, or Firm*—Burgess, Ryan & Wayne; Milton J. Wayne; William R. Moran

(57) ABSTRACT

A swash plate (3, 18) and pistons (6, 17) included in a swash plate type compressor are made of an aluminum alloy as a base material. Rotation-preventive interfering surfaces (**6*d*, 17*d*) of the pistons (6, 17) which interfere with another member to restrain the pistons from rotation about their axes are coated with a film of a solid lubricant. Sliding contact surfaces (6*a*, 17*a*) of the pistons (6, 17) in sliding contact with surfaces defining cylinder bores (5, 16**) are coated with a film of a solid lubricant.

When the rotation-preventive interfering surfaces (**6*d*) of the pistons (6) come into impulsive contact with the outer circumference (3*b*) of the swash plate (3), the outer circumference (3*b*) of the swash plate (3**) is coated with a lubricating film.

19 Claims, 7 Drawing Sheets

SWASH PLATE TYPE COMPRESSOR

TECHNICAL FIELD

The present invention relates to a swash plate type compressor and, more particularly, to a swash plate type compressor provided with a swash plate and pistons which are finished by improved surface treatment to exercise enhanced performance, and capable of functioning with improved reliability.

BACKGROUND ART

A double-headed swash plate type compressor applied to an automobile air conditioning system, for example, has a drive shaft, a pair of cylinder blocks supporting the drive shaft for rotation, and a swash plate fixedly supported on the drive shaft for rotation together with the drive shaft in a swash plate chamber formed in a region including the boundary between the pair of cylinder blocks. A plurality of cylinder bores are formed so as to extend in both the cylinder blocks and are arranged around the drive shaft. Double-headed pistons are fitted for axial movement in the cylinder bores, respectively. Each piston is operatively engaged with the swash plate by shoes. The rotary motion of the swash plate is converted into the linear motion of the pistons for the suction, compression and discharge of a refrigerant gas.

A single-headed swash plate type compressor has a cylinder block and a housing closing the inner end of the cylinder block and having a swash plate chamber or a crank chamber. A swash plate is mounted on a drive shaft in the swash plate chamber and is linked to pistons by shoes. In a variable-displacement swash plate compressor, a swash plate is linked to single-headed pistons fitted in a plurality of cylinder bores by shoes, and is mounted on a drive shaft so as to wobble on a supporting point. The inclination of the swash plate is changed according to pressure in the crank chamber so that gas pressures acting on the opposite ends of the single-headed piston balance each other. Consequently, the stroke of the single-headed piston is adjusted to control the displacement of the compressor.

A significant demand for weight reduction in those swash plate type compressors has progressively increased in order to apply the swash plate type compressors to automobile air conditioning systems, and most of the swash plates and the pistons, as well as the cylinder blocks, of those swash plate type compressors are made of aluminum alloys in light-weight constructions. Therefore, abrasion-resistant and seizing-preventive measures have been examined for protecting surfaces exposed to severe, high-speed abrasive action for a long time, such as the surfaces of the swash plate in sliding contact with the shoes, and the sliding contact surface of the piston in sliding contact with the surface of the bore. Such measures include the formation of a fluorocarbon resin film on the sliding contact surface of the piston and the formation of a film of a solid lubricant on the sliding contact surface of the swash plate.

However, the double-headed piston is provided with a recess extending across the periphery of the swash plate, and interfering surfaces formed in the recess to restrain the piston from rotation come into impulsive contact with the outer circumference of the swash plate to restrain the piston from rotation by a rotation moment acting on the piston. The single-headed piston is provided with a rotation-preventive interfering surface in its base end part, and the interfering surface comes into impulsive contact with the inner surface of the housing to restrain the piston from rotation. Accordingly, it is possible, under a substantially nonlubricated state which occurs at the start of the compressor, that seizing occurs at the interfering surface of the piston and the outer circumference of the swash plate, and attempts have been made to form a lubricating film over the interfering surface of the piston and the outer circumference of the swash plate. Nevertheless, the yield of a coating material used in, for example, a spray coating process for coating the pistons and the swash plate with a lubricating film is extremely low. Furthermore, the spherical surfaces of the pistons must be masked in the spray coating process and the spray coating process is hardly satisfactory in working efficiency.

DISCLOSURE OF THE INVENTION

It is an object of the present invention to provide an improved swash plate type compressor capable of providing improved functional reliability attained by employing, in combination, an improved swash plate and improved pistons provided with an excellent lubricating film capable of being manufactured with a high productivity.

Another object of the present invention is to provide a long-life swash plate type compressor capable of properly functioning for an extended period of use when applied to an automobile air conditioning system and driven by the engine of a vehicle to compress a refrigerant.

In accordance with the present invention, there is provided a swash plate type compressor which comprises: a cylinder block provided with a plurality of cylinder bores; pistons fitted in the cylinder bores; a drive shaft supported for rotation about its axis of rotation; and a swash plate supported for rotation together with the drive shaft, having at least sliding contact surfaces to be in sliding contact with shoes and linked to the pistons by the shoes;

wherein the pistons are made of an aluminum alloy as a base material, each piston has an interfering surface which is interfered with by another member to restrain the piston from rotation, and the interference surfaces of the pistons are coated with a film of at least one solid lubricant selected from molybdenum disulfide, tungsten disulfide and graphite.

In the described swash plate type compressor, the excellent lubricating performance of the film of the solid lubricant formed on the interfering surface for retraining the piston from rotation effectively prevents the seizing of the interfering surface, and the outer circumference of the swash plate, i.e., another member, or the inner surface of a crank chamber with which the interfering surface comes into nonlubricated contact, enhances the functional reliability of the swash plate compressor, and extends the life of the swash plate compressor.

The seizing preventing effect of a film of a solid lubricant containing molybdenum disulfide as an essential component is particularly remarkable.

If the sliding contact surface of the piston in sliding contact with a surface defining the cylinder bore is coated with a film of a material containing a fluorocarbon resin as a principal component or a film of a solid lubricant, the abrasion resistance and the seizing preventing capability of the piston sliding in the bore can be improved.

When a transfer method is employed in forming the lubricating films on the sliding contact surfaces of the pistons in sliding contact with surfaces defining the cylinder bores, and the rotation-preventive interfering surfaces of the pistons, the coating material is not wasted, masking work is unnecessary when forming the film, and it is very advantageous in quality assurance, such as film thickness control.

In a swash plate type compressor in which the rotation-preventive interfering surfaces of pistons come into impulsive contact with the outer circumference of a swash plate to prevent the pistons from rotation, it is preferable to plate the outer circumference of the swash plate with a metal containing tin as a principal component or to form a lubricating film of a solid lubricant on the outer circumference of the swash plate. In the swash plate compressor, the cooperative effect of the outer circumference of the swash plate and the interfering surfaces of the pistons further effectively prevents the seizing of the pistons and the swash plate.

A metal layer of a material containing tin as a principal component formed by plating so as to underlie the film of the solid lubricant formed on the outer circumference of the swash plate will further enhance the durability of the film.

Obviously, the film of the solid lubricant can quite simply be formed on the outer circumference of the swash plate by a transfer method.

BRIEF DESCRIPTION OF THE DRAWINGS

The above and other objects, features and advantages of the present invention will become apparent from the ensuing description, taken in conjunction with the accompanying drawings, wherein.

BEST MODE OF CARRYING OUT THE INVENTION

Figure 1:
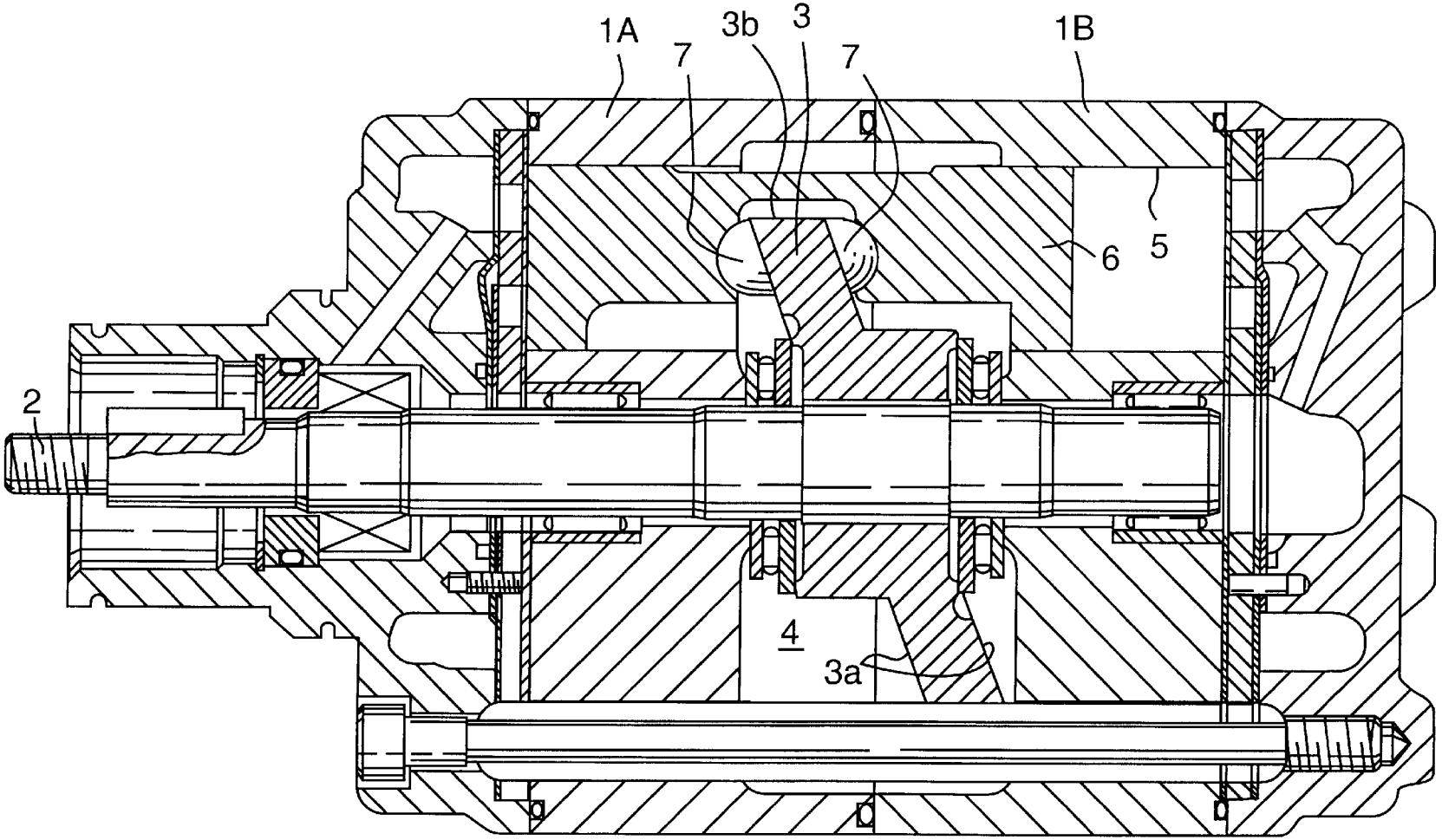
FIG. 1 is a longitudinal sectional view of a double-headed swash plate type compressor in a preferred embodiment according to the present invention.
Figure 2A:
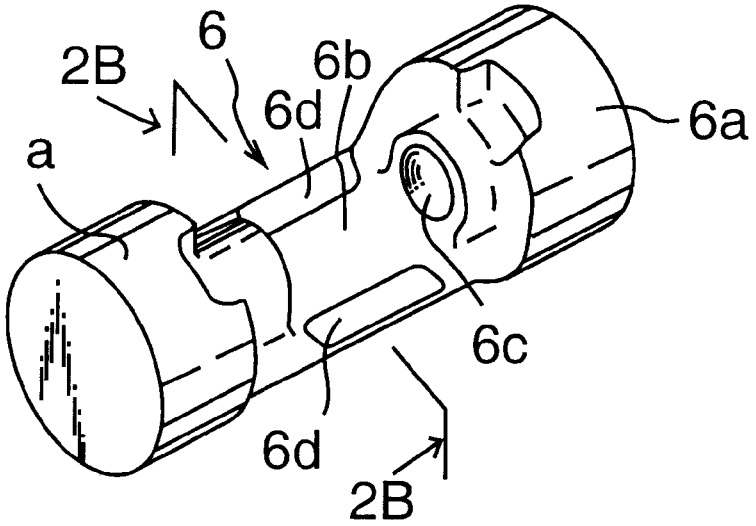
FIG. 2A is a perspective view of a double-headed piston employed in the compressor of FIG. 1.
Figure 2B:
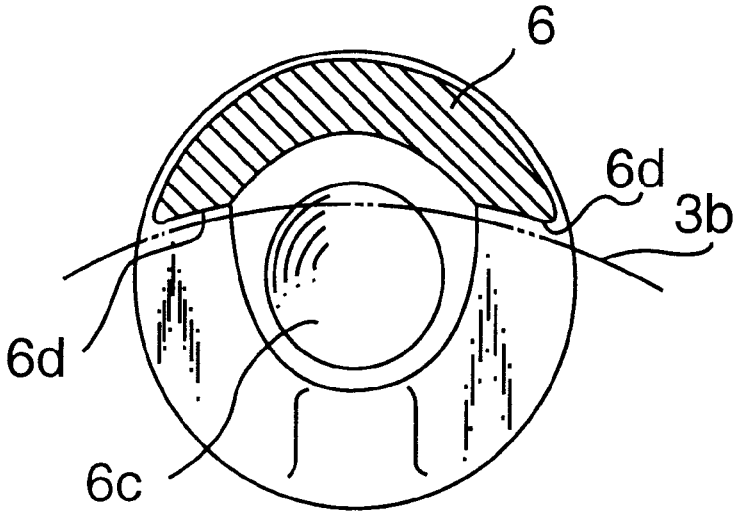
FIG. 2B is a longitudinal sectional view taken on line 2B—2B in FIG. 2A, showing the positions of interference surfaces.

Referring to FIGS. 1, 2A and 2B, a double-headed swash plate type compressor has a front cylinder block 1A and a rear cylinder block 1B, and a drive shaft 2 is supported for rotation about an axis of rotation on the cylinder blocks 1A and 1B. A swash plate chamber 4 is formed in a region around the joint of the cylinder blocks 1A and 1B in the cylinder blocks 1A and 1B. A swash plate 3 is contained in the swash plate chamber 4 and is combined with the drive shaft 2 for rotation together with the drive shaft 2. Bores of a predetermined diameter are formed in the cylinder blocks 1A and 1B, and the cylinder blocks 1A and 1B are joined together with the respective axes of the corresponding bores aligned with each other so as to form a plurality of axial cylinder bores (hereinafter referred to simply as "bores") 5 arranged around the drive shaft 2. Opposite end parts of double-headed pistons 6 are fitted in the bores 5, respectively, for axial sliding movement. Each piston 6 is linked to the sliding contact surfaces 3*a* of the swash plate 3 by shoes 7. A rotary motion of the swash plate 3 is converted into a linear motion of the piston 6 for the suction, compression and discharge of a refrigerant gas.

In this embodiment, the shoes 7 are made of a ferrous metal, the cylinder blocks 1*a* and 1B and the swash plate 3 and the double-headed pistons 6 are made of an aluminum alloy, such as a hypereutectic aluminum-silicon alloy.

As best shown in FIGS. 2A and 2B, the double-headed piston 6 has cylindrical sliding contact surfaces 6*a* of a predetermined length formed in the opposite end parts thereof and capable of being slidably fitted in the bores 5, and a recess 6*b* formed in a middle part thereof between the opposite end parts provided with the sliding contact surfaces 6*a* so as to extend across the outer circumference of the swash plate 3. Semispherical seats 6*c* on which the shoes 7 are seated, respectively, are formed axially opposite to each other in the recess 6*b*. Interfering surfaces 6*d* for restraining the piston 6 from rotation are formed axisymmetrically in the middle part. The interfering surfaces 6*d* come into impulsive contact with the outer circumference 3*b* of the swash plate 3 to inhibit the rotation of the piston 6 about its axis due to a rotation moment exerted by the shoes 7 on the piston 6.

Figure 3:
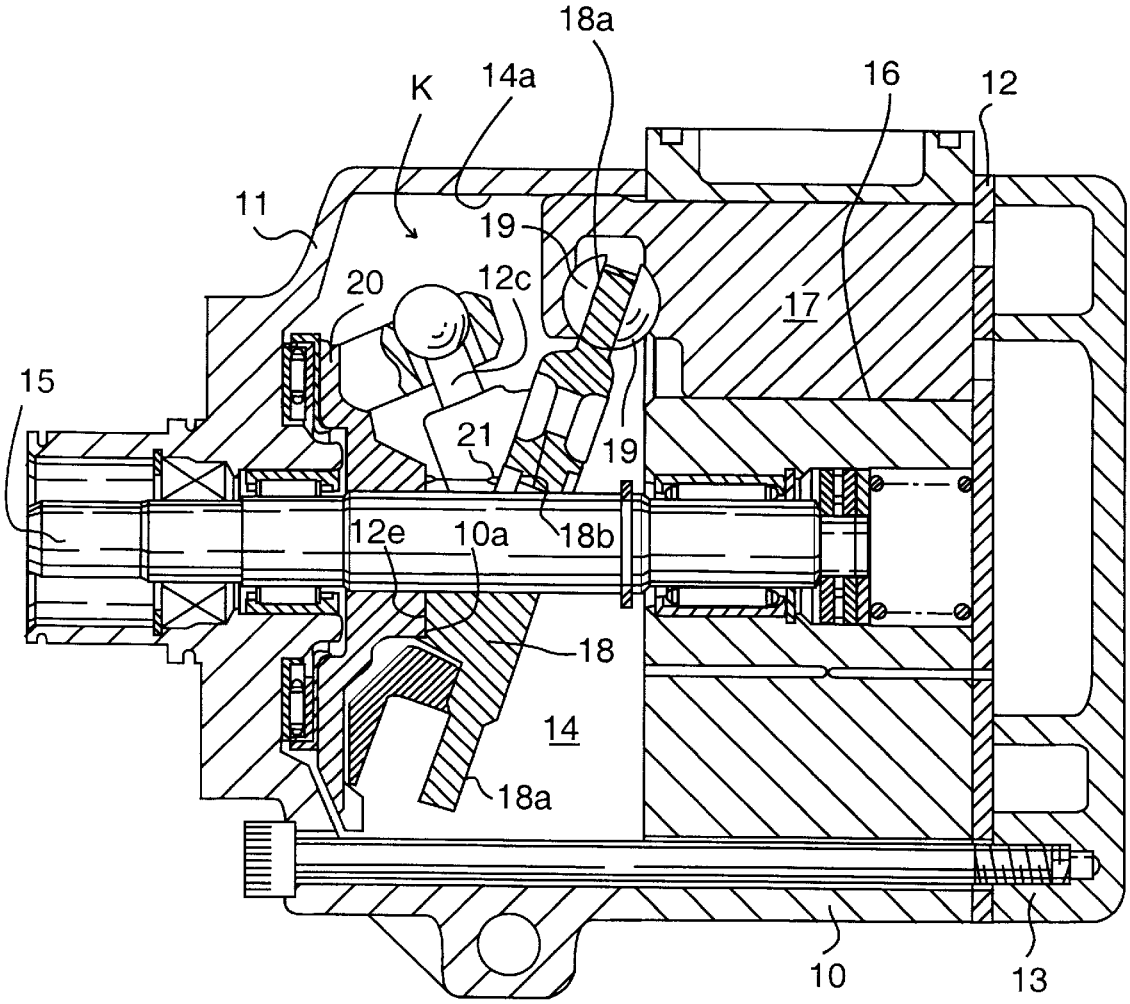
FIG. 3 is a longitudinal sectional view of a single-headed swash plate type compressor in another embodiment according to the present invention.
Figure 4A:
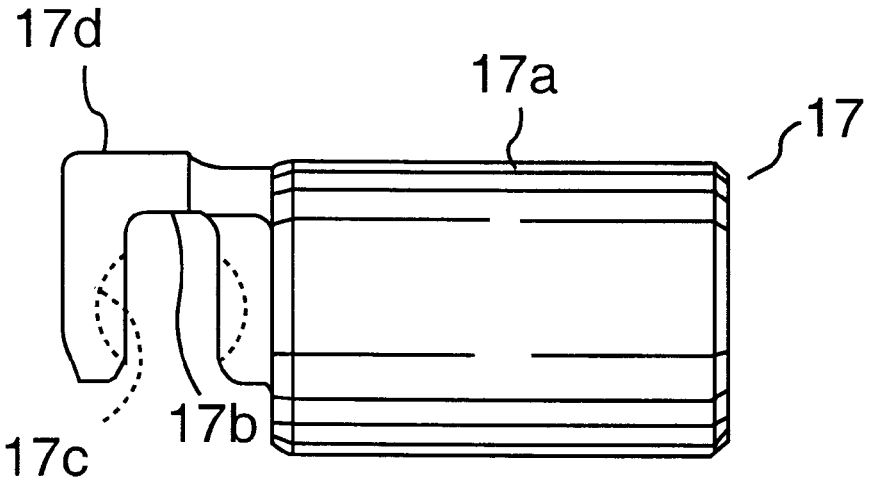
FIG. 4A is a front view of a single-headed piston employed in the compressor of FIG. 3.
Figure 4B:
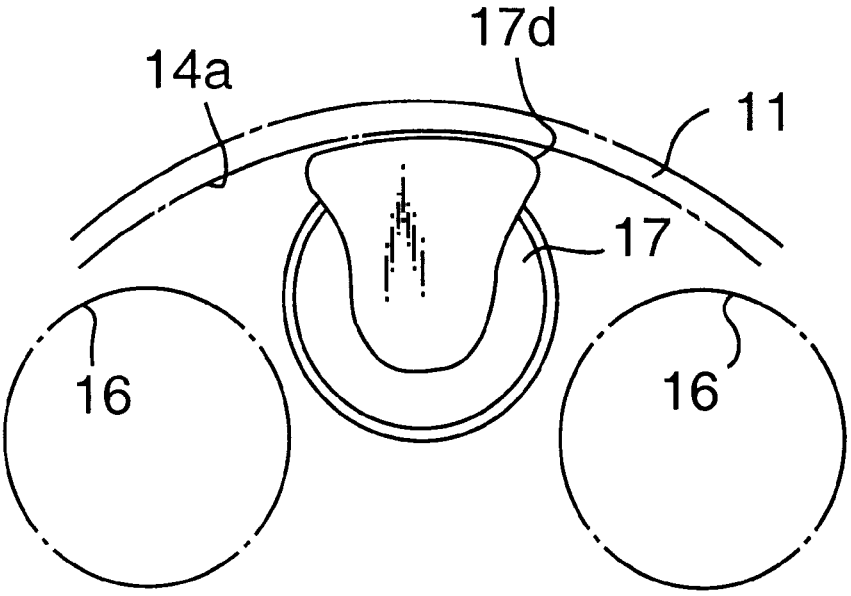
FIG. 4B is a rear end view showing a rotation-preventive interfering surface formed in the single-headed piston.

Referring to FIGS. 3, 4A and 4B, a variable-displacement swash plate type compressor in another embodiment according to the present invention has a cylinder block 10 having opposite end surfaces, a front housing 11 joined to the cylinder block 10 so as to cover the front end of the cylinder block 10, a valve plate 12 placed on the rear end surface of the cylinder block 10, and a rear housing 13 joined to the cylinder block 10 so as to cover the rear end of the cylinder block 10. The cylinder block 10, the front housing 11 and the rear housing 13 are firmly fastened together with through bolts so that the joints thereof are sealed. In the compressor, the cylinder block 10 and the front housing 11 define a crank chamber 14, and a drive shaft 15 is extended axially in the crank chamber 14 and is supported for rotation in a pair of radial bearings held respectively on the cylinder block 10 and the front housing 11.

A plurality of cylinder bores (hereinafter referred to simply as "bores") 16 are formed around the drive shaft 15 in the cylinder block 10, and single-headed pistons 17 are fitted for reciprocation in the bores 16, respectively.

In the crank chamber, a rotor 20 is fixedly mounted on the drive shaft 15 for rotation together with the drive shaft 15. An axial load exerted on the rotor 20 is sustained through a thrust bearing by the front housing 11. A swash plate 18 is mounted on the drive shaft 15 at a position behind the rotor 20. The swash plate 18 is always biased backward by the resilience of a compression spring interposed between the swash plate 18 and the rotor 20.

The swash plate 18 has a shape generally resembling a plate and is provided with flat sliding contact surfaces 18*a* formed on the opposite sides of a peripheral part thereof. Semispherical shoes 19 are put in contact with the sliding contact surfaces 18*a*, respectively. The shoes 19 are in sliding contact with semispherical seats 17*c* formed in the piston 17. A hinge mechanism K is formed between the swash plate 18 and the rotor 20 to allow the swash plate 18 to move pivotally relative to the rotor 20.

The swash plate 18 is provided with a bent central hole 18*b* formed through a central part thereof. The drive shaft 15 is extended through the central hole 18*b* to support the swash plate 18 thereon. The inclination of the swash plate 18 is variable without varying the top dead center of each single-headed piston 17 relative to the corresponding bore 16. When the swash plate 18 is inclined to a maximum inclination position, a projecting surface 10*a*, projecting from the swash plate 18 abuts against a projection 12*e* on rotor 20 which restricts further movement of the swash plate 18 from the maximum inclination position.

In this embodiment, the cylinder block 10, the swash plate 18 and the piston 17 are made of an aluminum alloy, such as a hypereutectic aluminum-silicon alloy. Each piston 17 is provided in its head part with a sliding contact surface 17*a* of a predetermined length fitting the bore 16, in its tail end part with a recess 17*b* (FIG. 4A) extending across the swash plate 18, and on the back side of a part thereof forming the recess 17*b* with a curved interfering surface 17*d* of a large radius of curvature capable of coming into impulsive contact with the inner surface 14*a* defining the crank chamber 14 to prevent the piston 17 from rotating.

The surface treatment of the piston, which is one of the features of the present invention, will be described with reference to FIGS. 5A to 7.

Although the double-headed piston 6 and the single-headed piston 17 included respectively in the swash plate type compressors in the foregoing embodiments differ from each other in shape, the double-headed piston 6 has rotation-preventive interfering surfaces 6*d* which come into impulsive contact with the swash plate 3 to restrain the piston 6 from rotation about its axis, and the single-headed piston 17 has the rotation-preventive interfering surface 17*d* which comes into impulsive contact with the inner wall surface 14*a* defining the crank chamber 14 to prevent or restrain the piston 17 from rotating about its axis. The interfering surfaces 6*d* and 17*d* are coated with films formed by coating the interfering surfaces 6*d* and 17*d* with films of a lubricating material prepared by mixing molybdenum disulfide and graphite chosen as solid lubricants, and a polyamidimide resin (bonding agent), and heating and hardening the films of the lubricating material. The sliding contact surfaces 6*a* and 17*a* of the parts of the pistons 6 and 17 fitted in the bores 5 and 16, respectively, are coated with a film of a generally used fluorocarbon resin (polytetrafluoroethylene).

The pistons 6 and 17 in those embodiments are provided with the rotation-preventive interfering surfaces 6*d* and 17*d*, which are subject to seizing, coated with the lubricating films of a solid lubricant, such as molybdenum disulfide. Therefore, the seizing resistance of the pistons 6 and 17 is far higher than that of pistons substantially entirely coated with a fluorocarbon resin.

Since the lubricating films formed on the sliding contact surfaces 6*a* and 17*a* and the interfering surfaces 6*d* and 17*d* of the pistons 6 and 17 are formed by a transfer method regardless of the materials, the lubricating films can very easily be formed without entailing substantial increase in work even if the lubricating films are formed of different materials. Further, strength of connection of the lubricating films to the above-mentioned sliding contact surfaces and to the above-mentioned sliding contact surfaces can be increased.

A transfer method (roller transfer method) of forming fluorocarbon resin films on the sliding contact surfaces 6*a*, 6*a* formed on a workpiece 6W for making the piston will be described.

Figure 5A:
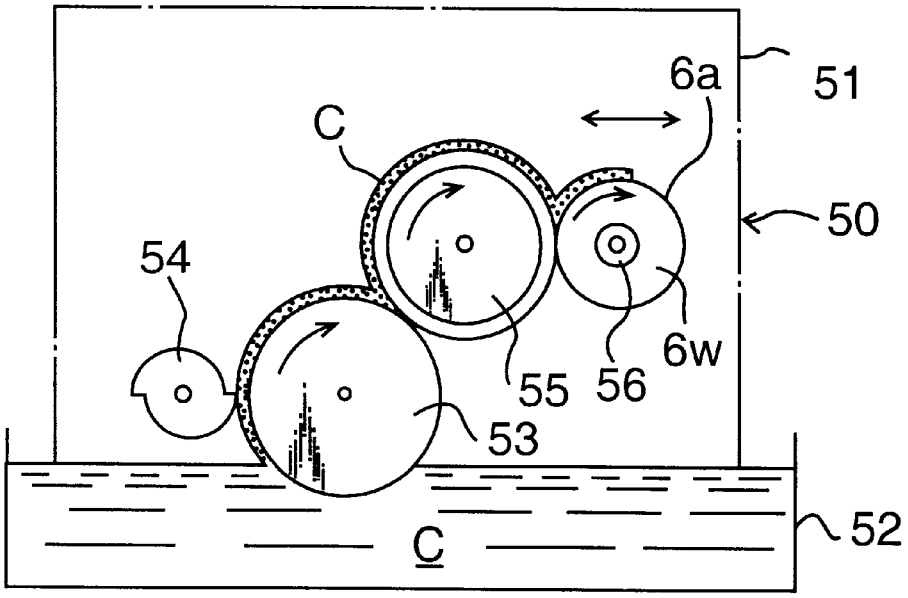
FIG. 5A is a typical view of a transfer apparatus for forming a film of a solid lubricant on the sliding contact surfaces of a piston by a transfer method.
Figure 5B:
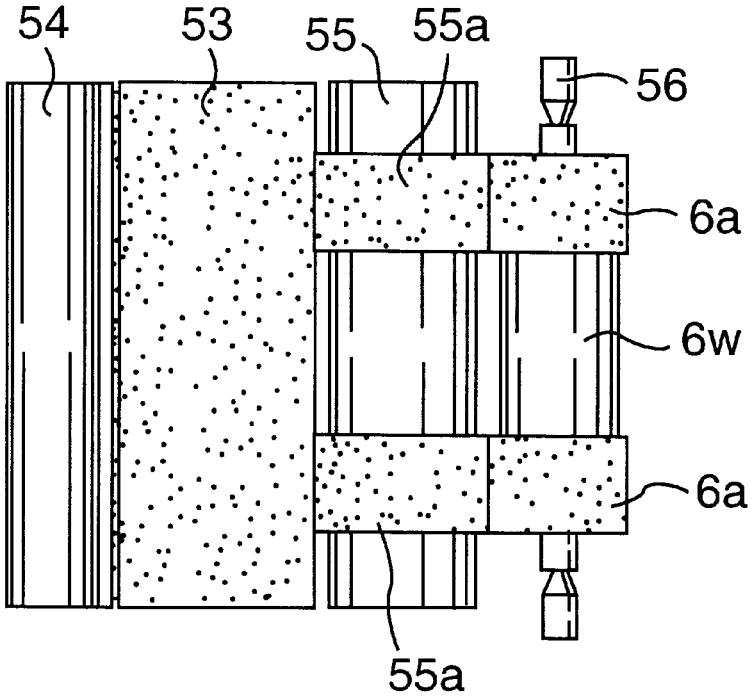
FIG. 5B is a typical development showing the relation between a workpiece for making a piston and a roller arrangement included in the transfer apparatus.

FIG. 5A is a typical view of a transfer apparatus and FIG. 5B is a development showing the workpiece for making eh piston, and rollers.

Referring to FIGS. 5A and 5B, a transfer apparatus 50 has a tank 52 containing a coating material "C" containing a lubricant, such as polytetrafluoroethylene, a binder resin, a solvent, such as N-methyl-pyrrolidone, and a filler, a metal roller 53 partly dipped in the coating material C contained in the tank 52, a comma roller 54 disposed near the metal roller 53 with a predetermined gap therebetween, a transfer roller 55 of a synthetic rubber having coating parts 55*a* of an increased diameter with which the sliding contact surfaces 6*a* of the workpiece 6W can be brought into contact, and disposed with the coating parts 55*a* in contact with the metal roller 53, a work holder 56 for rotatably holding the workpiece 6W, and a driving mechanism 51 for driving the rollers 53 and 55 for rotation in the directions of the arrows.

When the rollers 53 and 55 are rotationally driven by the driving mechanism 51, the coating material C adheres to the circumference of the metal roller 53, the thickness of a layer of the coating material C on the metal roller 53 is adjusted by the comma roller 54, and the layer of the coating material C is transferred from the metal roller 53 to the coating parts 55*a* of the transfer roller 55. When the rotating workpiece 6W is brought into contact with the transfer roller 55 by the work holder 56, the coating material C is applied (transferred) to the sliding contact surfaces 6*a* of the workpiece 6W from the transfer roller 55.

Then the workpiece 6W is separated from the transfer roller 55 and is removed from the work holder 56. The workpiece 6W is subjected to a drying process to remove the solvent from the coating material C and is subjected to a baking process to form films firmly adhering to the sliding contact surfaces 6*a*.

A transfer method (roller transfer method) of forming films of a solid lubricant on the interfering surfaces 6*d* of the workpiece 6W for making the piston will be described hereinbelow.

Figure 6A:
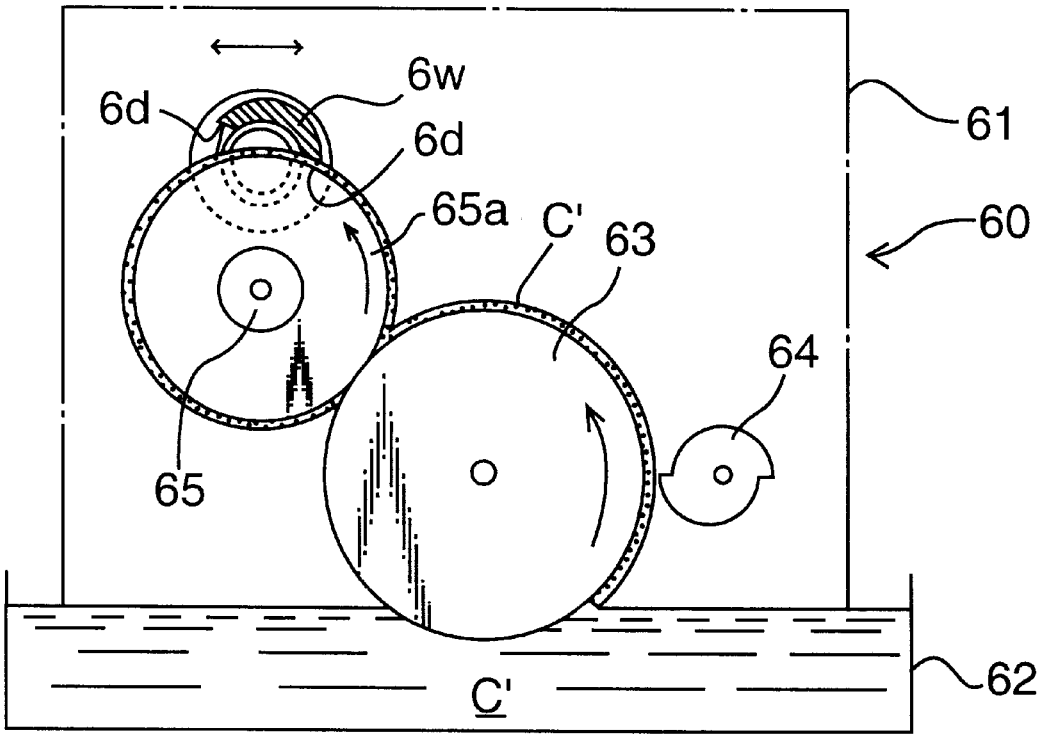
FIG. 6A is a typical view of a transfer apparatus for forming a film of a solid lubricant on the rotation-preventive interfering surfaces of a double-headed piston.
Figure 6B:
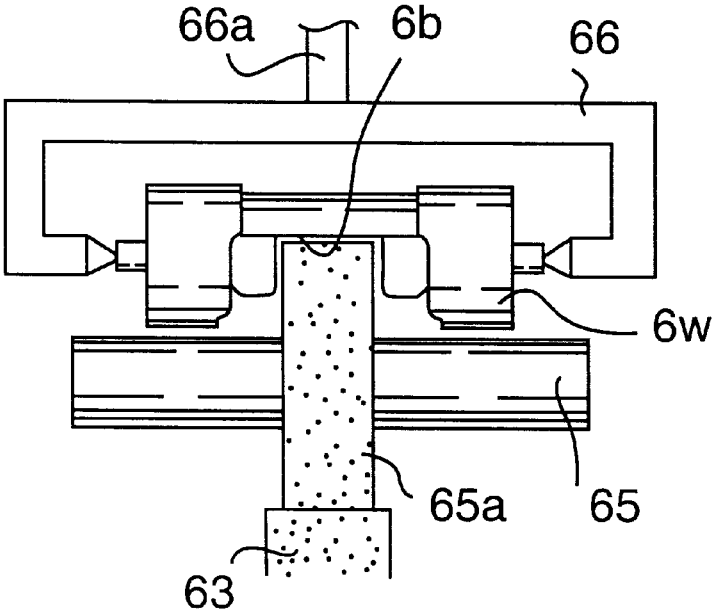
FIG. 6B is a typical development schematically showing the relation between a workpiece for making a piston held on a transfer apparatus and a roller arrangement included in the transfer apparatus.

Referring to FIGS. 6A and 6B, a transfer apparatus 60 has a tank 62 containing a coating material C' containing a solid lubricant, such as a mixture of molybdenum disulfide and graphite, and a unhardened thermosetting resin, such as a polyamidimide resin, a metal roller 63 partly dipped in the coating material C' contained in the tank 62, a comma roller 64 disposed near the metal roller 63 with a predetermined gap therebetween, a transfer roller 65 of a synthetic rubber having coating parts 65*a* of an increased diameter having a width corresponding to that of the interfering surfaces 6*d* of the workpiece 6W and capable of being inserted in the recess 6*b*, and a driving mechanism 61 for driving the rollers 63 and 65 for rotation in the directions of the arrows. A robot arm 66 for supporting the workpiece 6W is capable of turning on its pivot shaft 66*a*, and of being turned through a predetermined angle about the axis of the workpiece 6W by a means, not shown.

When the rollers 63 and 65 are rotated by the driving mechanism 61, the coating material C' adheres to the circumference of the metal roller 63, the thickness of a layer of the coating material C' on the metal roller 63 is adjusted by the comma roller 64, and the layer of the coating material C' is transferred from the metal roller 63 to the coating part 65*a* of the transfer roller 65. When one of the interfering surfaces 6*d* of the workpiece 6W supported on the robot arm 66 is brought into contact with the transfer roller 65 by turning the workpiece 6W clockwise, as viewed in FIG. 6A, about its axis through a predetermined angle, the coating material C' is transferred to the interfering surface 6*d* to coat the same. Subsequently, the workpiece 6W is moved to the right to separate the workpiece 6W from the transfer roller 65, the workpiece 6W is reversed on the pivotal shaft 66*a* of the robot art 66, and then the workpiece 6W is moved to the left to bring the other interfering surface 6*d* into contact with the transfer roller 65. Consequently, the other interfering surface 6*d* is coated with the coating material C'. Subsequently, the workpiece 6W is subjected to a drying process and a baking process to form films firmly adhering to the interfering surfaces 6*d*.

Figure 7:
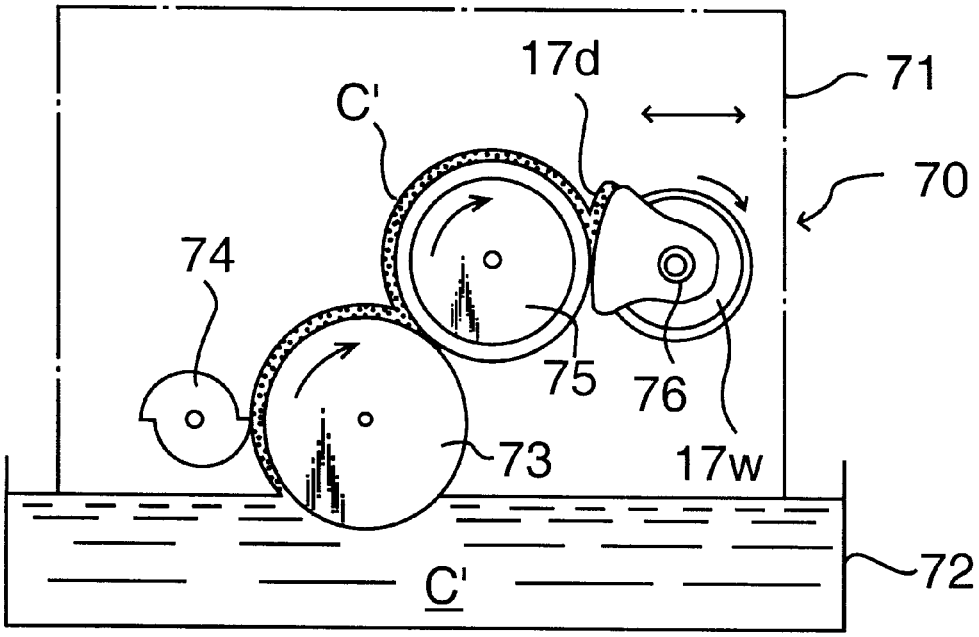
FIG. 7 is a typical view of a transfer apparatus for forming a film of a solid lubricant on the rotation-preventive interfering surfaces of a single-headed piston by a transfer method.

FIG. 7 shows a transfer apparatus for forming a film of a solid lubricant on the interfering surface 17*d* of a workpiece 17W for making a piston. The transfer apparatus 70 is provided with rollers 73 and 75 and a driving mechanism 71 similar to those of the transfer apparatus 50 shown in FIGS. 5A and 5B.

Accordingly, a transfer method to be carried out by the transfer apparatus 70 is basically the same as that to be carried out by the transfer apparatus 50. Since the center of curvature of the interfering surface 17*d* is at a considerable distance from the center of turning of the workpiece 17W, a work holder 76 is provided with a mechanism for permitting a displacement of the center of rotation of the workpiece 17W, not shown.

Description of the surface treatment of the outer circumference 3*b* of the swash plate 3 with which the rotation-preventive interfering surface 6*d* of the piston 6 comes into impulsive contact will be provided hereinbelow.

The outer circumference 3*b* of the swash plate 3 is covered with a plated metal layer of a metal containing tin as a principal component and, if necessary, a film of a solid lubricant is formed on the plated metal layer.

Figure 8:
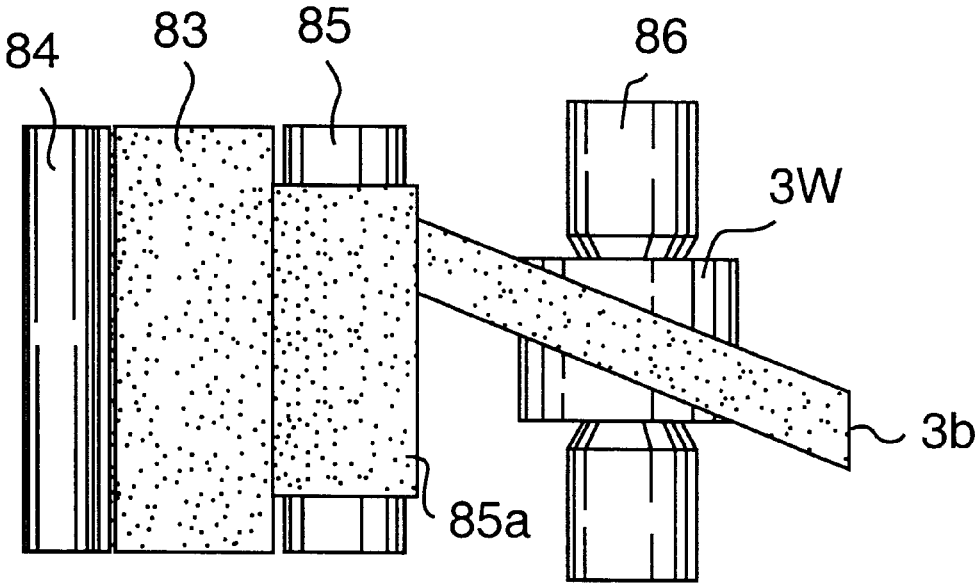
FIG. 8 is a typical view of a transfer apparatus for forming a film of a solid lubricant on the outer circumference of a swash plate by a transfer method.

FIG. 8 shows a transfer apparatus for forming a film of a solid lubricant on the outer circumference 3*b* of a workpiece 3W for making the swash plate. Since the transfer apparatus has rollers 83, 84 and 85 and work holder 86 whose functions are similar to those of the transfer apparatus shown in FIGS. 5A and 5B, and carries out substantially the same transfer method as those in the foregoing embodiments, the specific description thereof will be omitted.

As is apparent from the foregoing description, according to the present invention, the rotation-preventive interfering surfaces of the pistons of the swash plate type compressor or both the sliding contact surfaces of parts of the pistons fitted in the bores and the interfering surfaces of the pistons are coated with the lubricating films, whereby the seizing of the interfering surface, and the outer circumference of the swash plate or the inner surface of the housing with which the interfering surface comes into nonlubricated contact can be effectively prevented.

When the lubricating films are formed on the interference surfaces and the sliding contact surfaces by a transfer method, the coating material is not wasted, masking work is unnecessary and the productivity can be improved. Further, strength of connection of the lubricating films to the sliding contact surfaces and to the sliding contact surfaces can be increased.

When the outer circumference of the swash plate with which the rotation-preventive interfering surfaces of the pistons come into impulsive contact is coated with the plated metal layer of a metal containing tin as a principal component and the lubricating film of a solid lubricant, and the swash plate is used in combination with the foregoing pistons, the seizing of the swash plate and the pistons can further effectively be prevented, and the plated metal layer of a metal containing tin as a principal component formed on the outer circumference of the swash plate and underlying the film of the solid lubricant further enhances the durability.

The film of the solid lubricant can very simply be formed on the outer circumference of the swash plate by a transfer mode.

LIST OF REFERENCE CHARACTERS

1A Cylinder block
1B Cylinder block
2 Drive shaft
3 Swash plate
3A Sliding contact surface
3B Outer circumference
4 Swash plate chamber
5 Cylinder bore
6 Double-headed piston
6A Sliding contact surface
6B Recess
6D Interfering surface
7 Shoe
10 Cylinder block
11 Front housing
12 Valve plate
13 Rear housing
14 Crank chamber
14A Inner wall surface
15 Drive shaft
16 Cylinder bore
17 Single-headed piston
17A Sliding contact surface
17D Interfering surface
18 Swash plate
18A Sliding contact surface
19 Shoe
50 Transfer apparatus
60 Transfer apparatus
70 Transfer apparatus

What is claimed is:

1. A swash plate type compressor comprising:

a cylinder block provided with a plurality of cylinder bores;

pistons slidingly fitted in said cylinder bores, respectively;

a drive shaft supported for rotation about its axis of rotation; and a swash plate supported for rotation together with said drive shaft, and operatively engaged with said pistons by shoes;

wherein said pistons are made of an aluminum alloy as a base material and have rotation-preventing interfering surfaces to restrain said pistons from rotation, wherein said rotation-preventing interfering surfaces are coated with a film of a solid lubricant containing at least one lubricating material selected from molybdenum disulfide, tungsten disulfide and graphite.

2. A swash plate type compressor according to claim 1, wherein said solid lubricant is molybdenum disulfide.

3. A swash plate type compressor according to claim 1, wherein said solid lubricant contains molybdenum disulfide, and at least one material selected from a fluorocarbon resin, tungsten disulfide and graphite.

4. A swash plate type compressor according to claim 1, wherein the rotation-preventing interfering surfaces of said pistons are formed so as to come into impulsive contact with an outer circumference of said swash plate, and said outer circumference of said swash plate is coated with a lubricating film.

5. A swash plate type compressor according to claim 1, wherein sliding contact surfaces of said pistons to in sliding contact with surfaces defining said cylinder bores are coated with a film of a fluorocarbon resin.

6. A swash plate type compressor according to claim 1, wherein sliding contact surfaces of said pistons to in sliding contact with surfaces defining said cylinder bores are coated with a film of a material containing a fluorocarbon resin, and at least one material selected from the group consisting of molybdenum disulfide, tungsten disulfide and graphite.

7. A swash plate type compressor according to claim 1, wherein the sliding contact surfaces of said pistons sliding contact with surfaces defining said cylinder bores are coated with a film of a solid lubricant containing at least one material selected from the group consisting of molybdenum disulfide, tungsten disulfide and graphite.

8. A swash plate type compressor comprising: a cylinder block provided with a plurality of cylinder bores; pistons slidingly fitted in said cylinder bores, respectively; a drive shaft supported for rotation about its axis of rotation; and a swash plate supported for rotation together with said drive shaft, and linked to said pistons by shoes wherein said pistons are made of an aluminum alloy as a base material and have rotation-preventing interfering surfaces which interfere with to restrain said pistons from rotation, wherein sliding contact surfaces of said pistons in sliding contact with surfaces defining said cylinder bores, and said interfering surfaces are coated with a lubricating film formed by a transfer method.

9. A swash plate type compressor according to claim 8, wherein said rotation-preventing interfering surfaces of said pistons are formed so as to come into impulsive contact with said outer circumference of said swash plate, and said outer circumference of said swash plate is coated with a lubricating film.

10. A swash plate type compressor according to claim 9, wherein said lubricating film formed on said outer circumference of said swash plate is a plated metal layer of a metal containing tin as a principal component.

11. A swash plate type compressor according to claim 9, wherein the lubricating film formed on said outer circumference of said swash plate is a film of a solid lubricant containing at least one material selected from the group consisting of molybdenum disulfide, tungsten disulfide and graphite.

12. A swash plate type compressor according to claim 11, wherein a plated metal layer of a metal containing tin as a principal component underlies said film of said solid lubricant formed on said outer circumference of said swash plate.

13. A swash plate type compressor according to claim 11, wherein said film of the solid lubricant coating said outer circumference of said swash plate is formed by a transfer method.

14. The swash plate type compressor according to claim 2, wherein said rotation-preventing interfering surfaces of an pistons are formed so as to come into impulsive contact with said outer circumference of said swash plate, and said outer circumference of said swash plate is coated with a lubricating film.

15. The swash plate type compressor according to claim 3, wherein said rotation-preventing interfering surfaces of an pistons are formed so as to come into impulsive contact with said outer circumference of said swash plate, and said outer circumference of said swash plate is coated with a lubricating film.

16. The swash plate type compressor according to claim 2, wherein sliding contact surfaces of said pistons in sliding contact with surfaces defining said cylinder bores are coated with a film of a fluorocarbon resin.

17. The swash plate type compressor according to claim 2, wherein sliding contact surfaces of said pistons in sliding contact with surfaces defining said cylinder bores are coated with a film of a material containing a fluorocarbon resin, and at least one material selected from the group consisting of molybdenum disulfide, tungsten disulfide and graphite.

18. The swash plate type compressor according to claim 2, wherein to be sliding contact surfaces of said pistons to be in sliding contact with surfaces defining said cylinder bores are coated with a film of a solid lubricant containing at least one material selected from the group consisting of molybdenum disulfide, tungsten disulfide and graphite.

19. The swash plate type compressor according to claim 12, wherein said film of said solid lubricant coating said outer circumference of said swash plate is formed by a transfer method.

* * * * *